US008614383B1

(12) United States Patent
Palais

(10) Patent No.: US 8,614,383 B1
(45) Date of Patent: Dec. 24, 2013

(54) LAP TAPPING INSTRUMENT

(71) Applicant: Steven Scott Palais, Oaklyn, NJ (US)

(72) Inventor: Steven Scott Palais, Oaklyn, NJ (US)

( * ) Notice: Subject to any disclaimer, the term of this patent is extended or adjusted under 35 U.S.C. 154(b) by 0 days.

(21) Appl. No.: 13/706,861

(22) Filed: Dec. 6, 2012

(51) Int. Cl.
*G10D 3/02* (2006.01)

(52) U.S. Cl.
USPC ..... 84/294

(58) Field of Classification Search
USPC ..... 84/267, 290, 291, 411 R, 421
See application file for complete search history.

(56) References Cited

U.S. PATENT DOCUMENTS 6,441,293 B1 * 8/2002 LaBarbera ..... 84/723

* cited by examiner

*Primary Examiner* — Kimberly Lockett
(74) *Attorney, Agent, or Firm* — Stuart M. Goldstein

(57) ABSTRACT

A lap tapping instrument which takes the form of a guitar, has a main body, a top surface with a sound hold therethrough, a bottom surface, sidewalls extending between the surfaces, a neck section with a fingerboard, and guitar strings extending over the sound hold and neck section. A percussive member having a series of parallel extending upstanding ridges is permanently secured to the top surface of the main body and an opening located through the sidewall has a connection for interchanging a plurality of different percussive accessories and attaching the accessories to the body of the instrument. The main body also has an optional top side opening into which other percussive accessories can be attached. The accessories are connected to the main body and interchanged with other accessories as the musician's need arise.

12 Claims, 3 Drawing Sheets

LAP TAPPING INSTRUMENT

BACKGROUND OF THE INVENTION

Lap tapping is a unique guitar or similar string instrument playing style which has been developed by a small number of technically talented guitarists. Although it is a relatively recent playing form, it continues to gain in popularity.

The lap tapping musician holds the instrument flat on his or her lap with the strings face-up, tapping the body of the instrument and strings percussively while playing the melody. Tapping is usually accomplished by the motion of the fingers almost simultaneously plucking the strings and tapping them against the fingerboard of the instrument. Other parts of the instrument, primarily the body, are tapped as well to provide additional percussive effect.

Currently, the lap tapping musician has been limited to the basic instrument, usually the guitar, with its body, strings, and neck/fingerboard. There are no other instrumental options available to enhance the musically experience of lap tapping.

SUMMARY OF THE INVENTION

It is thus the object of the present invention to provide an improved lap tapping instrument which integrally incorporates components and accessories, thereby providing the musician with additional percussive options while playing.

These and other objects are accomplished by the present invention, a lap tapping instrument which can take the form of a guitar having a main body, a top surface with a sound hold therethrough, a bottom surface, sidewalls extending between the surfaces, a neck section with a fingerboard, and guitar strings extending over the sound hold and neck section. A percussive member having a series of parallel extending upstanding ridges is permanently secured to the top surface of the main body and an opening located through the sidewall has a connection for interchanging a plurality of different percussive accessories and attaching the accessories to the body of the instrument. The main body also has an optional top side opening into which other percussive accessories can be attached. The accessories are connected to the main body and interchanged with other accessories as the musician's need arise.

The novel features which are considered as characteristic of the invention are set forth in particular in the appended claims. The invention, itself, however, both as to its design, construction and use, together with additional features and advantages thereof; are best understood upon review of the following detailed description with reference to the accompanying drawings.

DETAILED DESCRIPTION OF THE INVENTION

Figure 1:
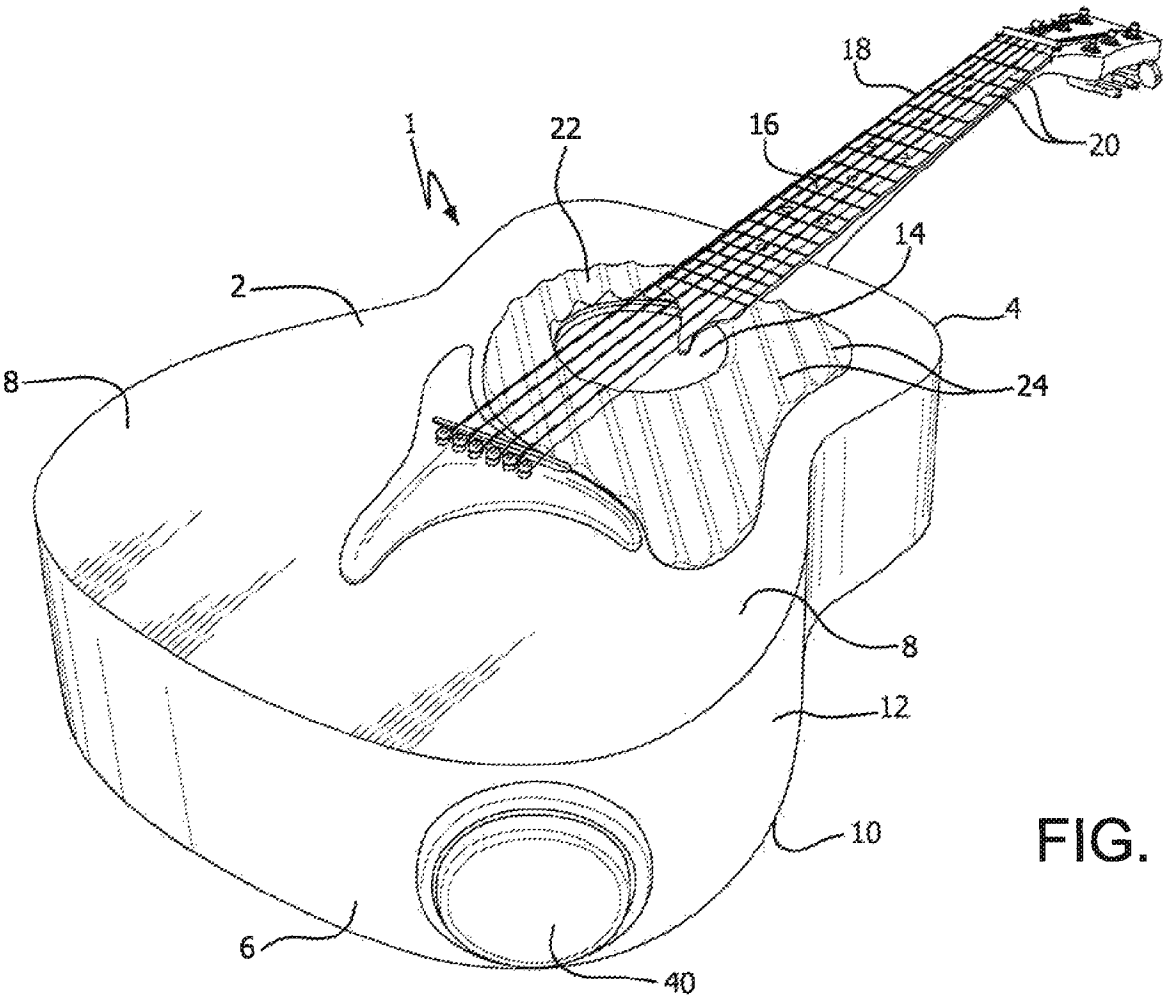
FIG. 1 is an isometric top/end view of the lap tapping instrument of the present invention with its bongo drum accessory connected to the body of the instrument.
Figure 4:
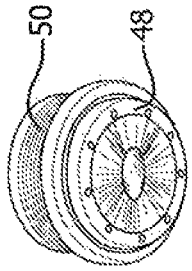
FIG. 4 is an isometric view of the egg shaker accessory of the lap tapping instrument of the present invention.
Figure 3:
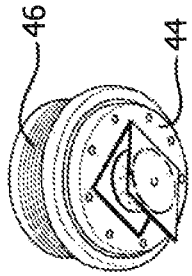
FIG. 3 is an isometric view of the castanet accessory of the lap tapping instrument of the present invention.
Figure 7:
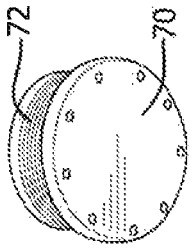
FIG. 7 is the cover of the lap tapping instrument of the present invention.
Figure 6:
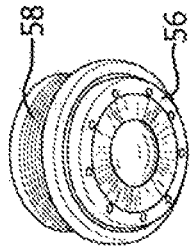
FIG. 6 is an isometric view of the ufo accessory of the lap tapping instrument of the present invention.
Figure 5:
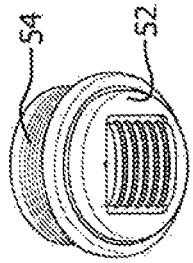
FIG. 5 is an isometric view of the cabasa accessory of the lap tapping instrument of the present invention.

Lap tapping instrument 1 is shown as a guitar in FIG. 1. However, the scope of the present invention is not to be considered restricted to a guitar configuration, but can be used in conjunction with a mandolin, ukulele, or similar stringed instrument in which the lap tapping style is played.

Instrument 1 comprises main body 2 having forward end 4, after end 6, top surface 8, bottom surface 10 in spaced apart relation with the top surface, and sidewall 12 extending between the top and bottom surfaces. Sound hole 14 extends through top surface 8 of the instrument. Neck section 16 with finger board 18 extends out from main body 2. Strings 20 connected to main body 2, extend over the finger board and neck section and sound hole of instrument 1.

Percussive member 22 is permanently secured to top surface of main body 2 and, as shown in FIG. 1, circumscribes sound hole 14, beneath the sound hole and strings 20. Percussive member 20 comprises a series of parallel, upstanding extending ridges 24. It is contemplated that percussive member 22 will be wood, hard plastic, or equivalent material which will withstand the percussive action of the musician on the percussive member.

Figure 2:
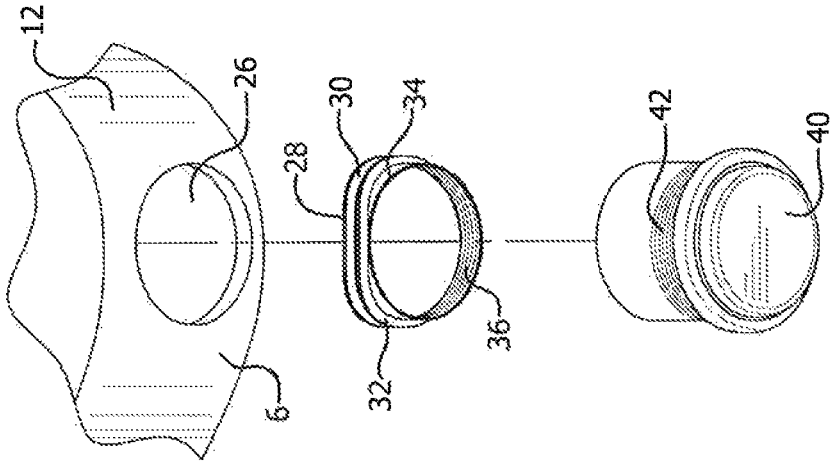
FIG. 2 is an exploded, partial end isometric view of the lap tapping instrument of the present invention, showing its bongo drum accessory component.
Figure 8:
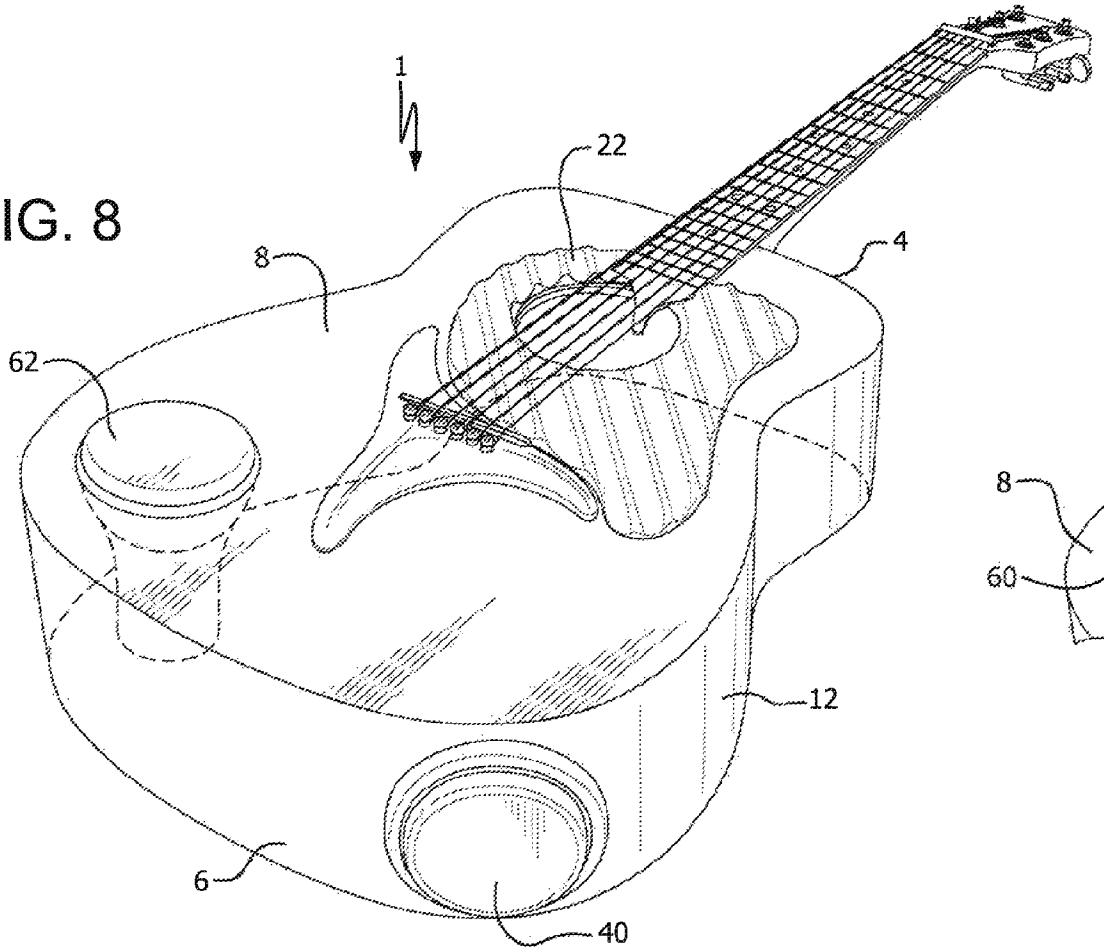
FIG. 8 is an isometric top/end view of the lap tapping instrument of the present invention with its bongo drum and djembe drum accessories connected to the body of the instrument.
Figure 9:
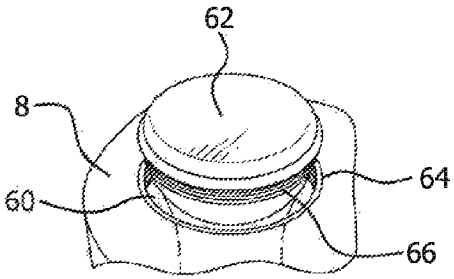
FIG. 9 is a detailed view of the manner of connection of the djembe drum accessory to the body of the instrument.

As best seen in FIG. 2, opening 26 extends through sidewall 12 near after end 6 of main body 2. Connection piece 28 comprises interior flange 30, exterior flange 32, and threaded connector 34 with internal threads 36. It is contemplated that flanges 30 and 32 of connection piece 28 will be made of flexible rubber and threaded connector will be made of hard plastic. By this construction, interior flange 30 of connection piece 28 can be positioned within opening 26 of main body 2, against the interior surface of the main body. Exterior flange 32 will thereby be positioned around opening 26, snugly against the outer surface of main body 2, and threaded connector 34 will extend out from sidewall 12 of the main body. Threaded connector 34 and, more specifically, its internal threads 36 are thus available to threadably engage various interchangeable percussive accessories.

For instance, bongo drum accessory 40 has threads 42 designed to threadably engage threads 36 of threaded connector 34 extending from sidewall 12 of main body 2. Other percussive accessories contemplated for connection to threaded connector 34 are castanet accessory 44 with threads 46, egg shaker 48 with threads 50, cabasa accessory 52 with threads 54, and ufo shaker 56 with threads 58. Each of these percussive accessories is interchangeable by threaded engagement with threads 36 of threaded connector 34, extending through opening 26 in sidewall 12.

Instrument 1 can also have opening 60 through top surface 8 of instrument 1, similar to that which was described with regard to opening 26 through sidewall 12. Connection piece 64, similar to connection piece 28, is inserted into opening 60. Another percussive accessory, for instance djembe drum accessory 62 with threads 66 can be inserted into opening 61) and secured by threadable engagement to connection piece 64 in the opening, as has been previously described with regard to the connections of the other percussive accessories.

Cover 70 with circumferential threads 72 is provided to threadably engage connection pieces 28 and 64, to close off the openings 26 and 60 when percussive accessories are not connected to instrument 1.

Lap tapping instrument 1 can thus be utilized alone, or in multiple combinations with various available percussive accessories. This provides greatly enhanced versatility to lap tapping instruments and, consequently, provides the musician with many different sounds and musical options.

While specific percussive accessories have been disclosed herein, this invention is not be considered restrictive to only those percussive accessories. It is contemplated that additional percussive accessories may be connected to the lap tapping instrument of the present invention and utilized in conjunction with the instrument, as described.

Certain novel features and components of this invention, are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A lap tapping instrument to be played on the lap of a musician, the instrument comprising:

a main body having forward and after ends, a top surface with a sound hole therethrough, a bottom surface in spaced apart relation to the top surface, and a sidewall extending between the top and bottom surfaces;

a neck section extending outwardly from the main body;

instrument strings secured to the main body and extending over the sound hole and neck section;

a percussive member permanently secured to the top surface of the main body beneath the strings and at least partially circumscribing the sound hole, said percussive member having a series of parallel, upstanding extending ridges;

an opening located through the sidewall;

a plurality of independent, separable percussive accessories, each percussive accessory having accessory connection means for removeably securing the percussive accessory to the opening;

sidewall opening connection means for engaging the accessory connection means of the percussive accessories and for removeably securing percussive accessories over the opening;

whereby the instrument is played by positioning the bottom surface of the main body on the lap of the musician with said strings facing upward towards the musician, the musician percussively tapping the main body, the strings, the percussive member, and the individual percussive accessory secured to the opening.

2. The lap tapping instrument as in claim 1 wherein the opening is located through the sidewall, near the after end of the main body.

3. The lap tapping instrument as in claim 1 further comprising a cover having cover connection means for engaging the sidewall opening connection means and removeably securing the cap member to the opening when none of the percussive accessories are secured to the opening connection means.

4. The lap tapping instrument as in claim 1 further comprising a second opening extending through the top surface of the main body.

5. The lap tapping instrument as in claim 4 further comprising top surface opening connection means for engaging the accessory connection means of the percussive accessories and for removeably securing a percussive accessory over the second opening.

6. The lap tapping instrument as in claim 1 wherein one of the plurality of percussive accessories is a bongo drum.

7. The lap tapping instrument as in claim 1 wherein one of the plurality of percussive accessories is a castanet.

8. The lap tapping instrument as in claim 1 wherein one of the plurality of percussive accessories is a percussive egg shaker member.

9. The lap tapping instrument as in claim 1 wherein one of the plurality of percussive accessories is a cabasa shaker member.

10. The lap tapping instrument as in claim 1 wherein one of the plurality of percussive accessories is a djembe drum.

11. The lap tapping instrument as in claim 1 wherein one of the plurality of percussive accessories is a ufo.

12. The lap tapping instrument as in claim 1 wherein the sidewall opening connection means comprises a connection piece having an interior flange, an exterior flange, and a threaded connector with internal threads.

* * * * *